US005498101A

United States Patent [19]

Braverman

[11] Patent Number: 5,498,101

[45] Date of Patent: Mar. 12, 1996

[54] ROAD BARRIER

[76] Inventor: Josef J. Braverman, 32 Loma Vista Drive, Thornhill, Ontario, Canada, L4J 7S3

[21] Appl. No.: 332,800

[22] Filed: Nov. 2, 1994

[51] Int. Cl.[6] ..... E01F 13/00

[52] U.S. Cl. ..... 404/6; 256/13.1

[58] Field of Search ..... 404/6, 9; 256/1, 256/13.1

[56] References Cited

U.S. PATENT DOCUMENTS

| | | | |
|---|---|---|---|
| 4,710,053 | 12/1987 | Kulp et al. | 404/6 X |
| 4,946,306 | 8/1990 | Yodock | 404/6 |
| 4,978,245 | 12/1990 | White | 404/6 |
| 5,104,254 | 4/1992 | Durand | 404/6 |
| 5,137,391 | 8/1992 | Ballesteros | 404/6 |

*Primary Examiner*—William P. Neuder
*Attorney, Agent, or Firm*—R. Craig Armstrong

[57] ABSTRACT

A plastic road barrier has an elongated base portion having an open center portion and a hollow peripheral portion surrounding the open center portion. The hollow peripheral portion has an inlet into an upper portion thereof for receiving water or other ballast, and an outlet from a lower portion thereof for draining the ballast. An elongated hollow upper portion, open at the bottom, extends upwardly from the base portion, and is preferably but not necessarily integral therewith. Its horizontal dimensions reduce from bottom to top, via steps and/or by being tapered, so that the barriers can be stacked by inserting the upper portion of one barrier a substantial distance into the upper portion of another barrier.

10 Claims, 8 Drawing Sheets

ROAD BARRIER

BACKGROUND OF THE INVENTION

1. Field of the Invention

This invention relates to a temporary road barrier, of the general type commonly used to separate traffic lanes from construction lanes.

2. Description of the Prior Art

Concrete barriers commonly known as "New Jersey" type barriers are very commonly used in many parts of the world. These concrete barriers act as physical barriers to vehicles, to prevent them from veering off the driving lanes into lanes where road construction or repair is under way. However, being of concrete, the barriers are very heavy, and require heavy equipment for handling, installation, and removal. This results in high cost, since more equipment and more time is required, and of course the barriers themselves are a significant expense. Also, due to the handling difficulties, installation and removal may impede traffic for longer than is necessary, which may have safety consequences.

Plastic substitutes for the concrete barriers do exist. See, for example, U.S. Pat. Nos. 4,040,759 (Skalle), 4,681,302 (Thompson), and 4,946,306 (Yodock). See also U.S. Pat. No. Re. 34,691 (White), which shows a hollow, stackable barrier, with a bladder which may be filled with water to weight the barrier down.

Needless to say, these plastic versions are much lighter and easier to handle than their concrete predecessors. However, despite this, there remains a need for an effective and inexpensive plastic barrier which can be easily supplied with ballast means, which preferably can be installed and removed by one person, and which can be efficiently and conveniently transported and stored, as well as offering other advantages.

It is of course recognized that a plastic barrier cannot serve as a substitute for a concrete barrier to provide a long-term, permanent barrier which will prevent traffic from crashing through from one area to another. However, as a temporary barrier or lane divider, plastic barriers are very useful. They are more effective than pylons, for example, since they appear to be more substantial, and therefore act as a psychological barrier, if not necessarily a true physical barrier.

SUMMARY OF THE INVENTION

It is an object of the invention to provide a plastic road barrier which offers advantages over existing plastic and concrete barriers.

In the invention, a plastic barrier is provided, with an elongated base portion having an open center portion and a hollow peripheral portion surrounding the open center portion. The hollow peripheral portion has an inlet into an upper portion thereof for receiving ballast means such as water or sand or the like, and an outlet from a lower portion thereof for draining the ballast means. An elongated hollow upper portion, open at the bottom, extends upwardly from the base portion, and is preferably but not necessarily integral therewith. Its horizontal dimensions reduce from bottom to top, via steps and/or by being tapered, so that the barriers can be stacked by inserting the upper portion of one barrier a substantial distance into the upper portion of another barrier.

Further features of the invention will be described or will become apparent in the course of the following detailed description.

BRIEF DESCRIPTION OF THE DRAWINGS

In order that the invention may be more clearly understood, the preferred embodiment thereof will now be described in detail by way of example, with reference to the accompanying drawings, in which.

DETAILED DESCRIPTION OF THE PREFERRED EMBODIMENT

Figure 1:
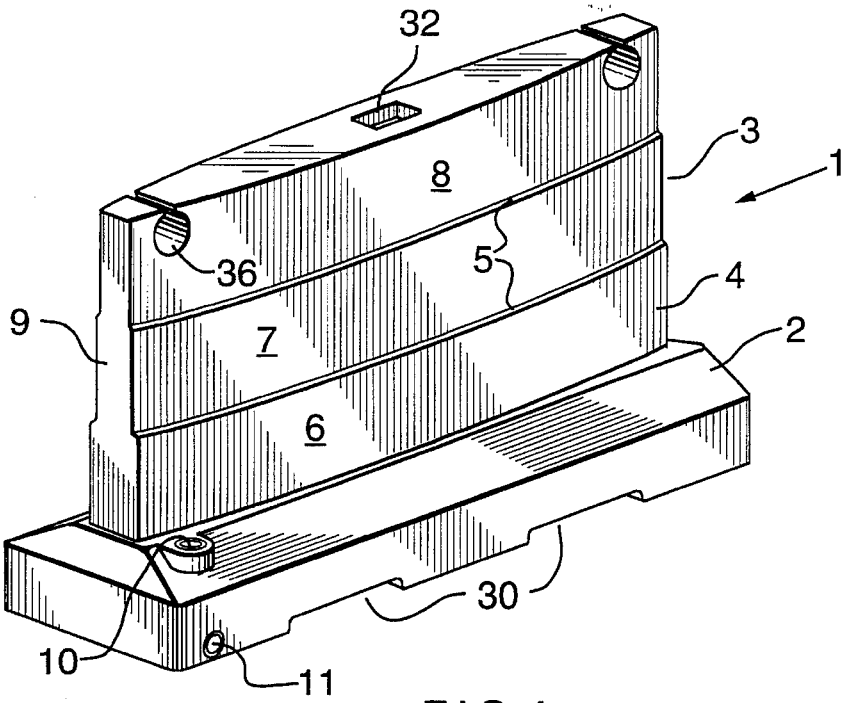
FIG. 1 is a perspective view of the preferred embodiment of the barrier.

The drawings show the preferred embodiment of the invention, which preferably is otationally molded ("rotomolded") from polyethylene. Obviously, other molding techniques and materials could be used if desired, but rotomolding has been determined to be the most efficient and cost effective method for the manufacture of the preferred embodiment.

The barrier 1 includes a hollow base portion 2 and an integral upper portion 3 extending upwardly from the base portion. The upper portion has horizontal dimensions which reduce from bottom to top, continuously by virtue of a taper, and/or incrementally by virtue of steps. For example, in the preferred embodiment as illustrated, the long face 4 of the barrier has two steps 5, dividing the upper portion into three areas, namely a lower area 6, a middle area 7, and an upper area 8. The depth, i.e. the front to back dimension, of the lower area is greater than that of the middle area, which in turn is greater than that of the upper area, at any point along the length of the barrier. The end faces 9 could be similarly stepped, but in the preferred embodiment they are continuously tapered from bottom to top, as can be best seen in FIG. 5.

Figure 6:
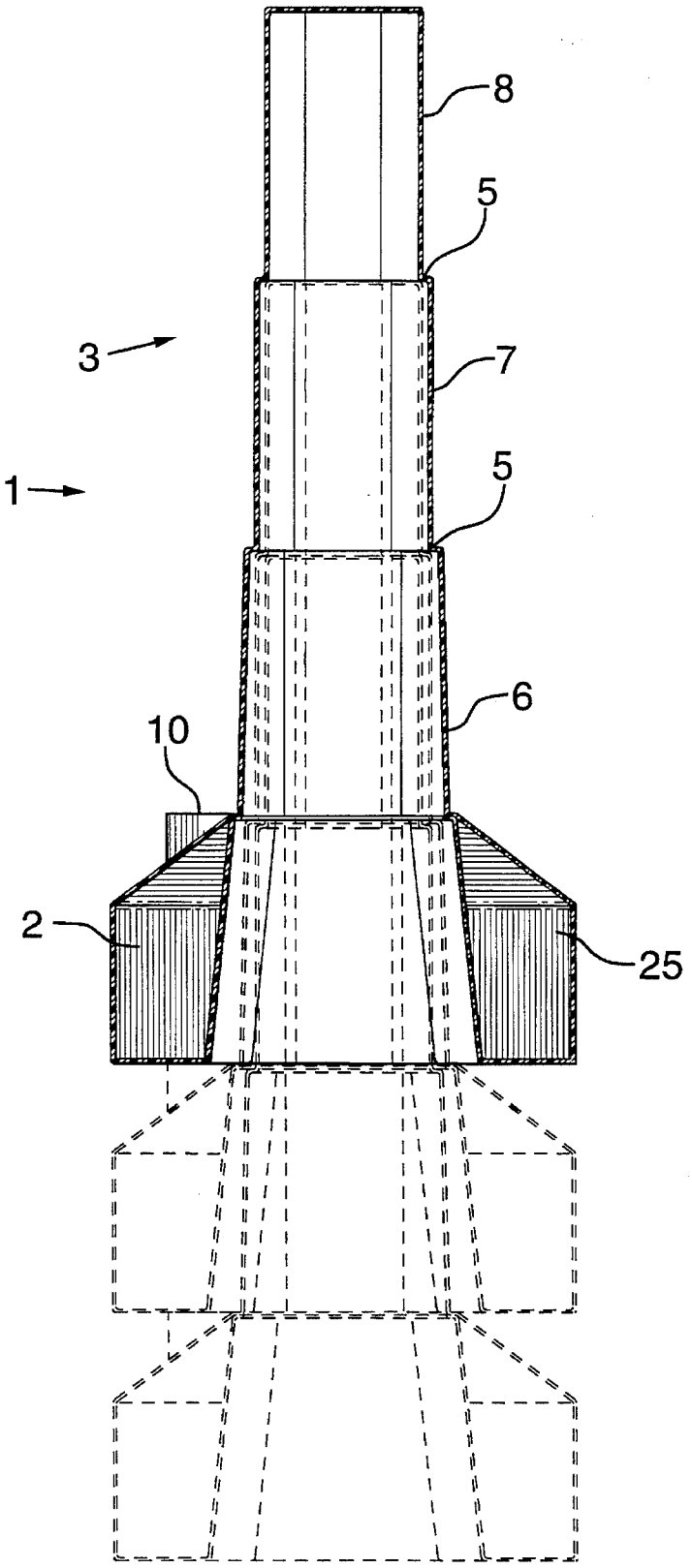
FIG. 6 is an end view, in cross-section, showing several barriers stacked on each other.
Figure 8:
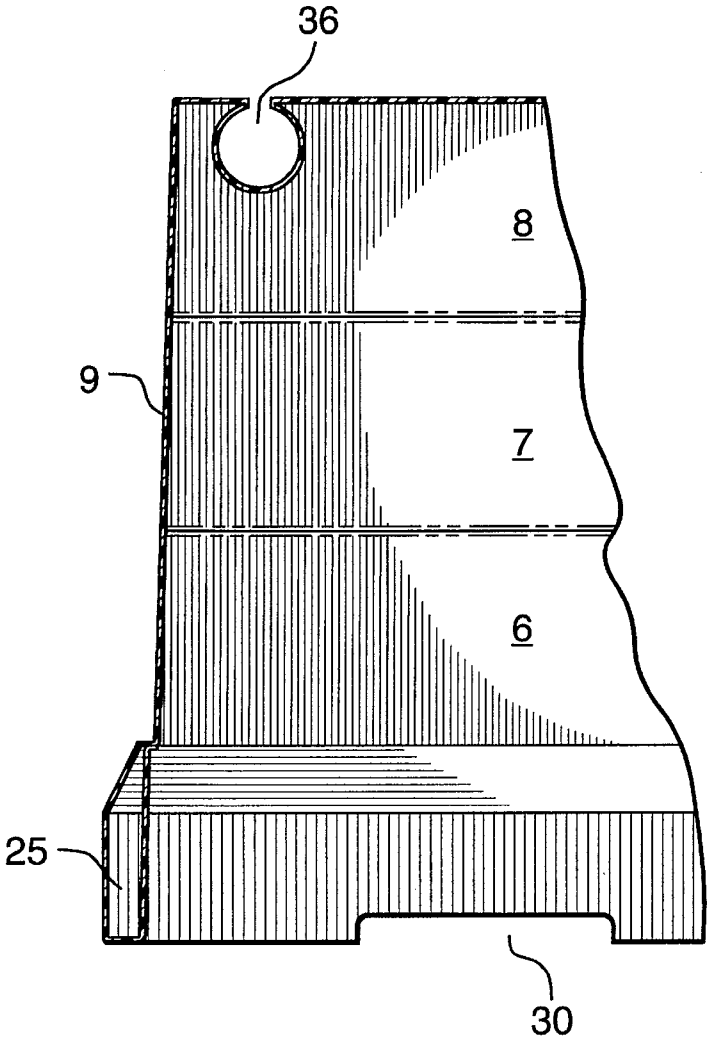
FIG. 8 is a side elevation view of the barrier, in cross-section.
Figure 7:
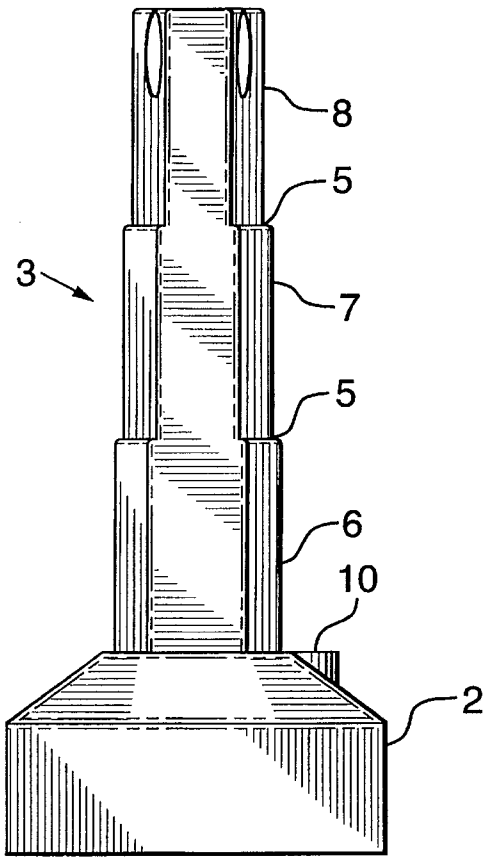
FIG. 7 is an end view of the barrier.

The center of each barrier is hollow and open at the bottom. As a result of this, and of the tapering and/or stepping, the barriers therefore stack together very efficiently, as shown in FIG. 6.

The base portion has an inlet 10 for the introduction of ballast material to the hollow base portion, and an outlet 11 for draining the ballast material. Water is the preferred ballast material, since it is readily available, inexpensive, and non-toxic, but obviously other materials could be used, including flowable solids such as sand. Antifreeze material such as salt may have to be added in cold weather.

Figure 3:
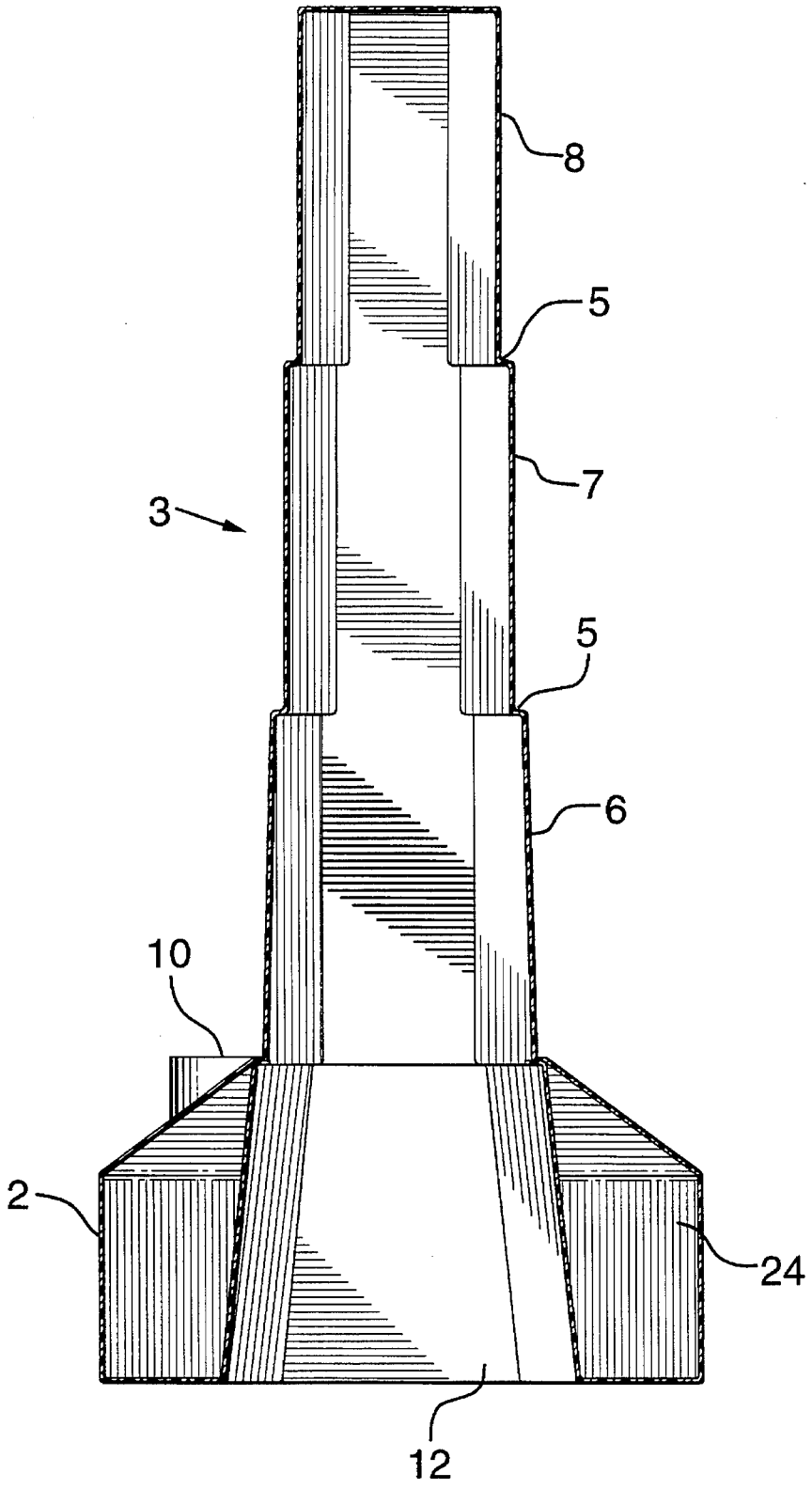
FIG. 3 is an end view of the barrier, in cross-section.

The mold is shaped to follow the external shape of the base, with a portion of the mold protruding upwardly into the center of the barrier, and having a flat portion at the height of the top of the base, that flat portion being insulated so that not as much plastic adheres to it. The remaining thin plastic portion 13, as seen best in FIGS. 3 and 9, can be easily cut away during the manufacturing process, leaving a hollow center 12, which permits stacking. Alternatively, although not preferred, the mold could be uninsulated, so that the normal thickness of plastic would form across the opening, and the plastic could be cut or routered away.

Figure 9:
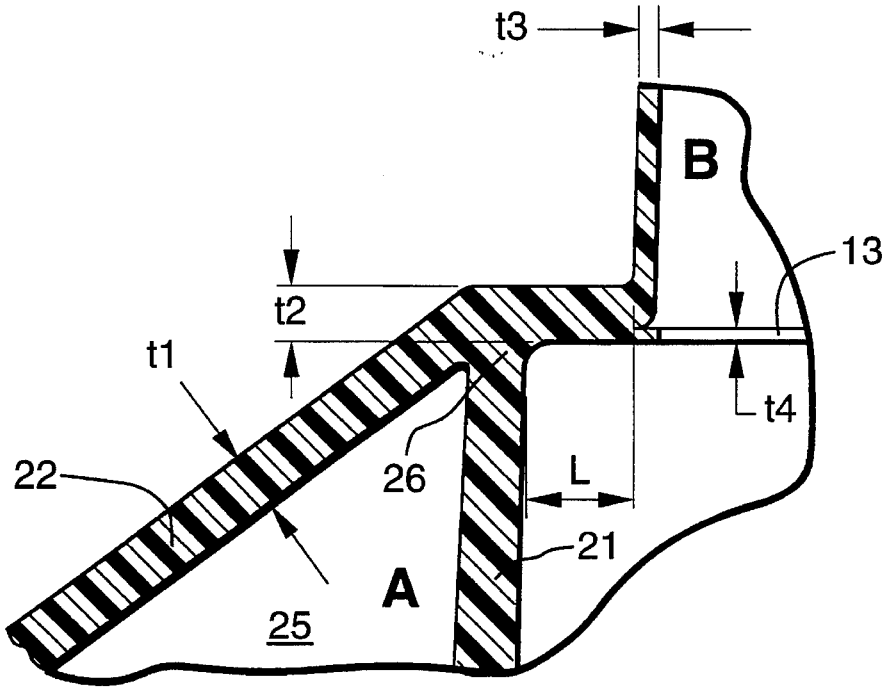
FIG. 9 is a cross-sectional view of a portion of the base according to the preferred embodiment.
Figure 10:
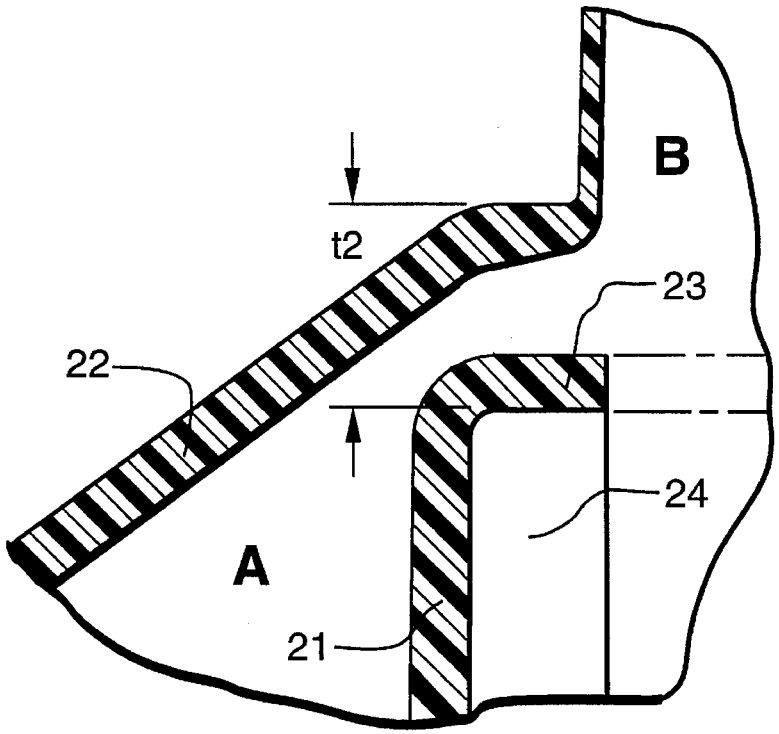
FIG. 10 is a cross-sectional view of a portion of the base according to an alternative embodiment.

When the barrier is manufactured as one integral piece, the base has an inner wall 21 and an outer wall 22, defining the ballast area 25 between them. Preferably, as shown in FIG. 9, the inner wall is bonded to the outer wall at a junction area 26. This is achieved by making the gap in the mold at that area sufficiently small that the plastic forms entirely across the gap. Referring to FIGS. 9 and 10, it has been found that the dimension t2 must be less than the sum of the dimensions $t_1$ and $t_4$ for this to occur. Also, to prevent "bridging" of the polyethylene material, i.e. leaving bubbles or unjoined areas within the intended junction area 26, it has been found that the ratio of the dimensions L to the dimension t should not exceed 2.5. At the same time, in order to prevent the free flow of powdered plastic from chamber A to chamber B during the rotomolding process, that ratio should be greater than about 1.3. Free flow of plastic from chamber A to chamber B is not desirable, since it prevents the wall thickness of the base from being maintained thicker than the wall thickness of the upper portion. Combining these requirements shows that the dimensions L and t should be according to the following formula: $1.3<L/t<2.5$.

Having the inner and outer wall 21 and 22 bond together to form a sealed ballast chamber is preferable for several reasons. First of all, it means that the barrier can still hold a ballast liquid even if lying on its side. Secondly, it permits the wall thickness of the base to be adjusted to be larger than the wall thickness of the upper portion, since separate powdered plastic charges can be inserted in chambers A and B of the mold, and they will remain essentially separate (except for some minor transfer before the wall thickness is built up sufficiently for the inner and outer walls to join at the junction area). This increased thickness of the base enhances stability of the barrier, by avoiding unnecessary weight in the upper portion and thus lowering the center of gravity, and provides strength where it is most needed, i.e. in the base. The effectiveness of plastic raw material use is thus improved, as it the cost of the product.

However, it should be understood that it is not essential for the inner and outer walls to join each other. Instead, there could be a gap as shown in FIG. 10. In that case, so that the weight of the ballast material does not cause the inner wall to cave inwardly to any excessive degree, a lip 23 and/or ribs 24 are provided in order to stiffen the inner wall sufficiently to resist excessive deformation.

The base is provided with recesses 30 for lifting the barrier with a forklift truck, if desired, and to allow any water to flow under the barrier. The barrier is intended to be easily movable by one person when empty, but obviously mechanical assistance may be required once the barrier is ballasted, if it desired to move it.

Preferably but not essentially, a recess 32 is provided in the upper surface of the upper portion, to receive the battery portion of a conventional flashing light 34.

Figure 2:
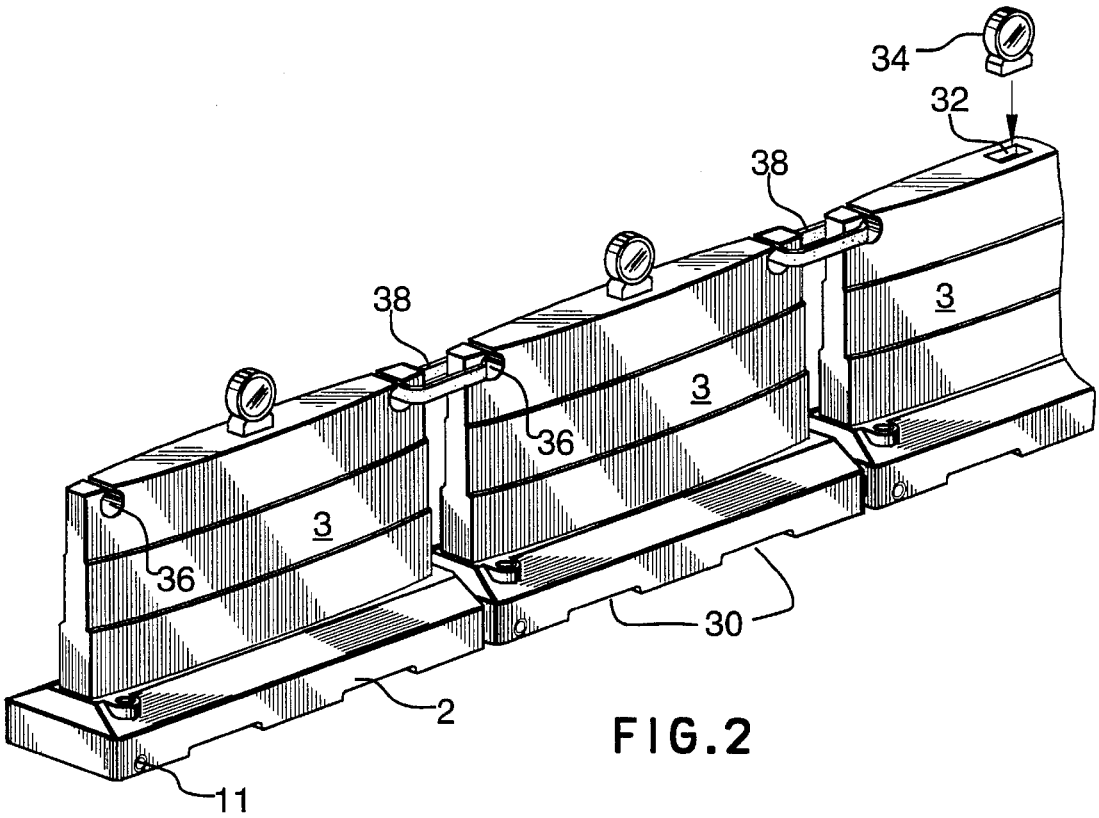
FIG. 2 is a perspective view of several of the barriers, connected end-to-end via straps to form a continuous barrier.
Figure 5:
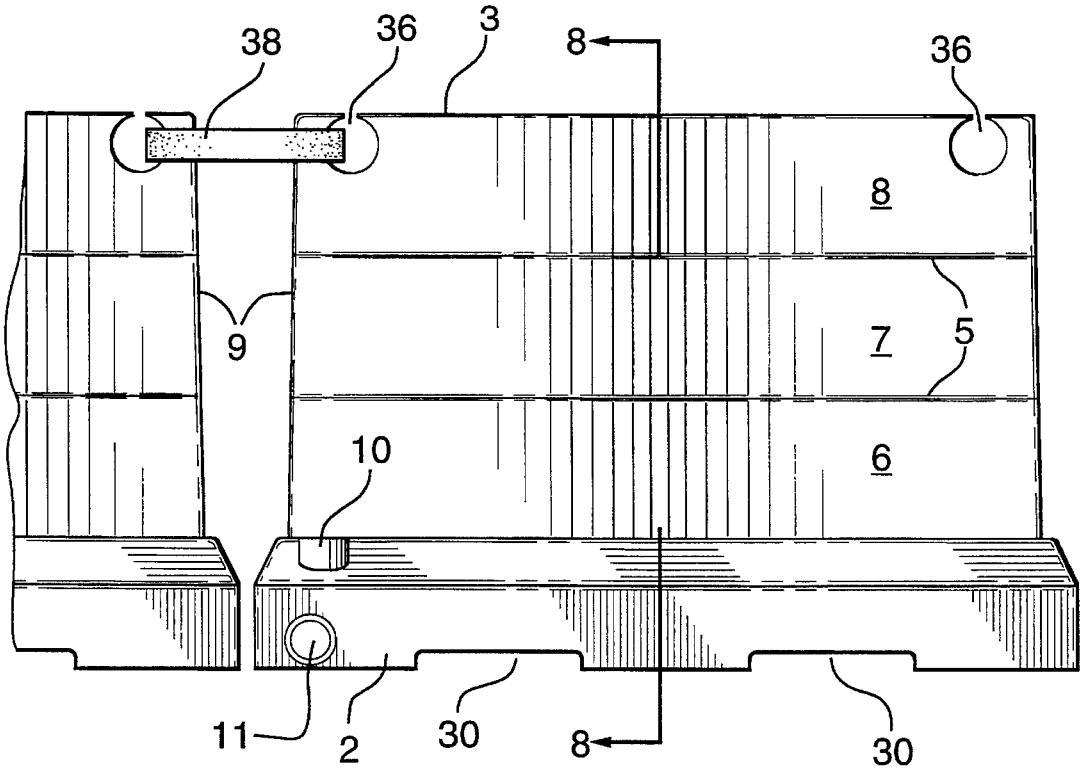
FIG. 5 is a side elevation view of a barrier, and part of an adjacent barrier.

Preferably but not essentially, curved openings 36 are provided through the upper portions, adjacent each end, which can be used as handles to make it easier to lift or manipulate the barriers, add which can be used to lash adjacent barriers to each other, as shown in FIGS. 2 and 5, via flexible straps, including Velcro (trademark) straps 38, ropes, rubber bands or the like. In addition to lashing the adjacent barriers to each other end-to-end, they could be lashed together in a variety of other configurations, such as to form a square or rectangular box with one or more barriers on each side, or to form a zig-zag shape with successive barriers at an angle to each other in alternating directions, or to form a circular or oval enclosure, or virtually any other desired shape. Because the lashing means is independent of the barriers themselves, there is great flexibility in the manner in which the barriers may be connected, by contrast with most prior art barriers, which tend to be configured for end-to-end connection only. Also, even if the barrier is damaged, the lashing means can still be used to lash barriers together. If an upper corner is broken off, for example, it is a simple matter to drill another hole or opening, and tie the barrier to its neighbour via the lashing means; the barrier does not become unusable as easily as with designs where the connection means is integral with the barrier structure.

Figure 11:
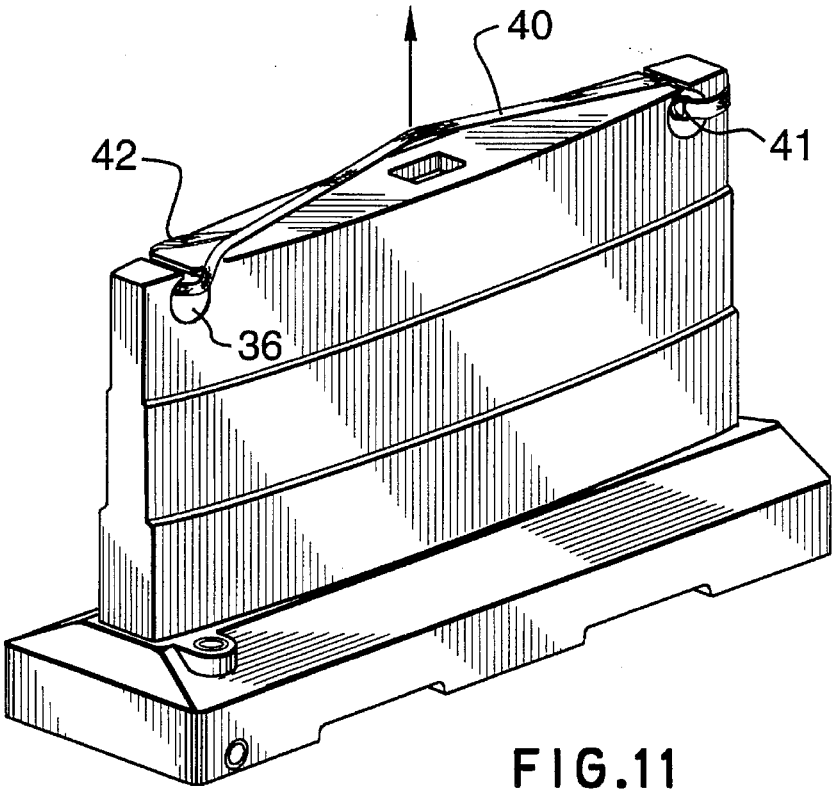
FIG. 11 is a perspective view of a barrier, showing a preferred connecting strap.
Figure 12:
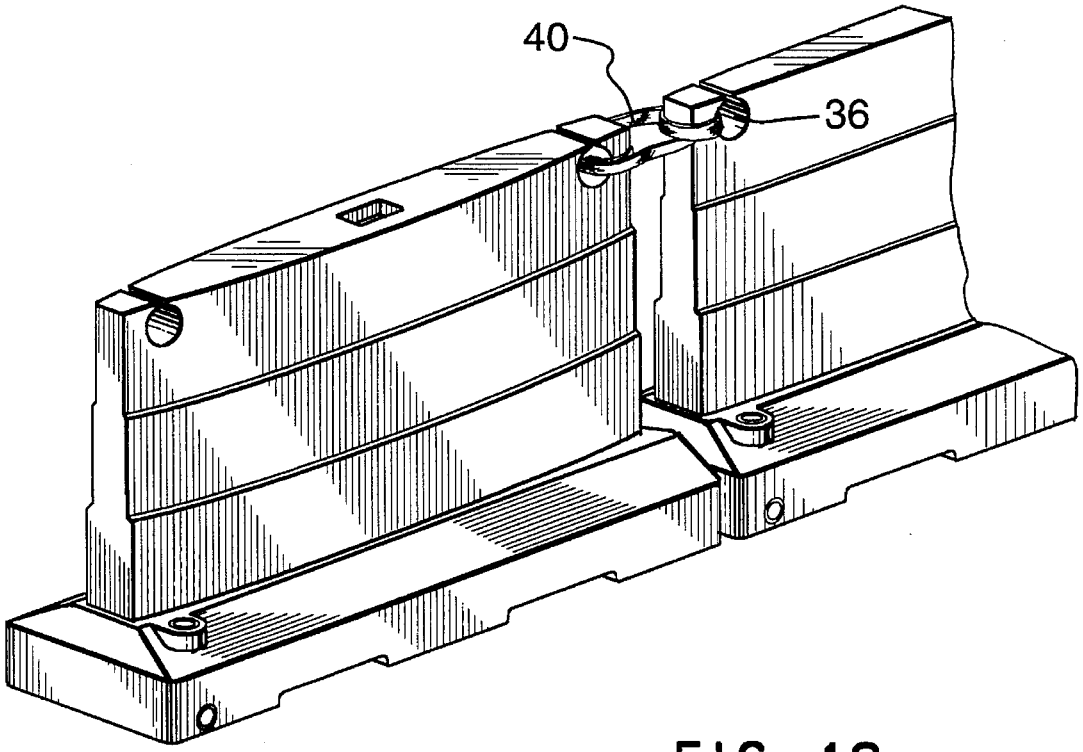
FIG. 12 is a perspective view of several barriers, connected end-to-end via the preferred connecting strap.

A preferred lashing means is shown in FIG. 11. A long strap 40 is fastened or tightened around one end of the barrier through one of the curved openings 36. The strap has a loop 42 formed at the opposite end, and is just long enough to loop over the edge of the curved opening at the other end of the same barrier. This provides not only a convenient storage position for the strap, but also allows the strap to act as a convenient carrying handle. To lash adjacent barriers together, the strap is simply routed through the curved opening of the adjacent barrier, and then back through the curved opening of the first barrier. It may then be tied off, or it may be more convenient to simply keep winding the strap through the curved openings until only the loop remains, with the loop then being hooked over one of the ends of the barrier via one of the curved openings. Alternatively, the barriers may be spread apart to almost the length of the strap, with the strap secured to one barrier, and simply looped into the opening of the next barrier, or preferably given one wrap and then looped. In this manner, the distance covered by a number of barriers may be nearly doubled.

The straps also provide for a great deal of flexibility in orienting adjacent barriers to each other in other than end-to-end positions, of course.

Figure 4:
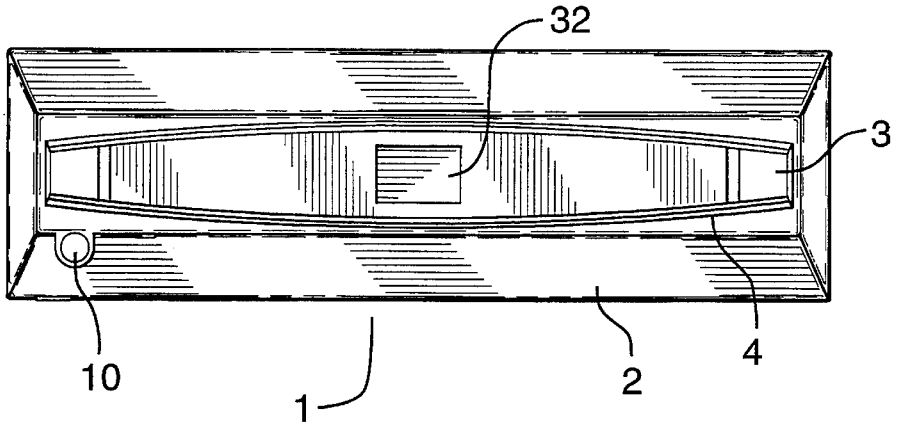
FIG. 4 is a top view of the barrier.

Preferably the upper portions are curved outwardly such that their width is greater at the midway point than at each end, as seen most clearly in FIG. 4, for two reasons. First of all, it avoids undesirable warpage or distortion of the plastic which could spoil the aesthetics of the product. Secondly, it avoids having the barriers present a continuous visual appearance when barriers are lined up end-to-end. This visual discontinuity keeps drivers more alert to the presence of the barriers, and thus enhances safety.

It should also be mentioned that because the barriers are of plastic, it is easy to produce barriers of different colours, which ma serve not only to enhance their appearance, but also to improve their visibility and to communicate information (e.g. yellow for caution, red for danger, etc.).

The approximate finished weight of the barrier is 20 kg. (44 pounds), which is well within the permitted weight for one worker to lift in most or all jurisdictions.

It will be appreciated that the above description relates to the preferred embodiment by way of example only. Many variations on the invention will be obvious to those knowledgeable in the field, and such obvious variations are within the scope of the invention as described and claimed, whether or not expressly described.

For example, it should be clear that a rectangular base is not essential. It could be somewhat oval, for example, as could be the upper portion.

Figure 13:
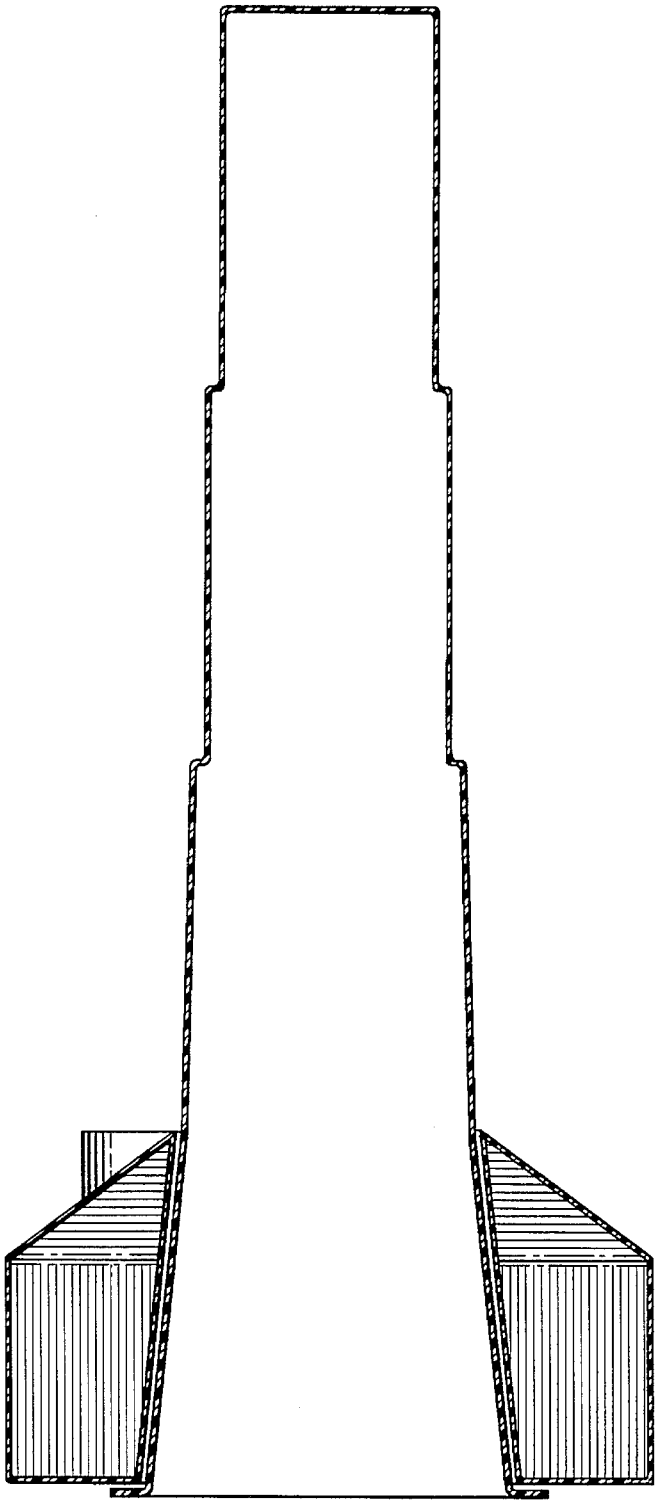
FIG. 13 is a cross-sectional view of an alternative embodiment.

Also, as shown in FIG. 13, the upper portion could be separate from the base portion. The base portion could be a "donut", for example, and the upper portion could extend down to the ground and then extend up through the "hole" of the donut, preferably with a bottom lip extending outwardly to engage the underside of the donut, so that the upper portion does not come loose and cannot be pulled up.

What is claimed as the invention is:

1. A plastic road barrier, comprising:

an elongated base portion having an open center portion and a hollow peripheral portion surrounding said open center portion, said hollow peripheral portion having an inlet into an upper area thereof for receiving ballast means and an outlet from a lower area thereof for draining said ballast means; and an elongated hollow upper portion with an open bottom, said upper portion extending upwardly from said base portion and having all horizontal dimensions reducing from bottom to top;

said barriers being stackable by virtue of said upper portion of one barrier being insertable a substantial distance into the upper portion of another barrier, via said open center of said base portion.

2. A road barrier as recited in claim 1, where said hollow peripheral portion of said base is defined by integral inner, outer, and bottom walls, said inner and outer walls converging a distance above said bottom wall, and being bonded to each other.

3. A road barrier as recited in claim 2, where the wall thickness of the base is greater than the wall thickness of the upper portion.

4. A road barrier as recited in claim 1, where said hollow peripheral portion of said base is defined by integral inner, outer, and bottom walls, said inner wall having reinforcement means to resist deformation by said ballast means.

5. A road barrier as recited in claim 4, where the wall thickness of the base is greater than the wall thickness of the upper portion.

6. A road barrier as recited in claim 1, where said base is provided with spaced-apart recesses parallel to each other from front to back sides of said barrier, particularly sized and spaced for lifting of the barrier with a forklift truck.

7. A road barrier as recited in claim 1, further comprising a recess provided in an upper surface of said upper portion, to receive the battery portion of a light.

8. A road barrier as recited in claim 1, where curved openings are provided through said upper portion, adjacent each end, said openings being open at the top of said upper portion, whereby adjacent road barrier may be lashed together by connecting means routed through said openings.

9. A road barrier as recited in claim 8, in combination with an elongated flexible strap which may be secured to said openings to connect adjacent barriers to each other in a variety of configurations.

10. A road barrier as recited in claim 1, where said upper portion is not integral with said base.

* * * * *